US009533178B2

(12) United States Patent
Kao

(10) Patent No.: US 9,533,178 B2
(45) Date of Patent: Jan. 3, 2017

(54) DEMOLITION UTILITY TOOL

(71) Applicant: Chih-Chen Kao, Taoyuan (TW)

(72) Inventor: Chih-Chen Kao, Taoyuan (TW)

( * ) Notice: Subject to any disclaimer, the term of this patent is extended or adjusted under 35 U.S.C. 154(b) by 7 days.

(21) Appl. No.: 14/607,373

(22) Filed: Jan. 28, 2015

(65) Prior Publication Data

US 2016/0158583 A1 Jun. 9, 2016

(30) Foreign Application Priority Data

Dec. 9, 2014 (TW) ..... 103221809 U

(51) Int. Cl.
*A62B 3/00* (2006.01)
*B25F 1/00* (2006.01)

(52) U.S. Cl.
CPC ..... *A62B 3/005* (2013.01); *B25F 1/006* (2013.01)

(58) Field of Classification Search
CPC ..... B25F 1/00; B25F 1/006; B25F 1/003; A62B 5/00; A62B 3/00; A62B 3/005; B25D 7/00; B25D 1/04; B25D 1/045; B25D 1/00; B25D 1/02; B26B 23/00; B25C 11/00; B66F 15/00; B25B 33/00
USPC ..... 7/158, 159, 161, 166, 169, 138, 143–147,7/142
See application file for complete search history.

(56) References Cited

U.S. PATENT DOCUMENTS 89,013 A * 4/1869 Blake ..... B25F 1/00 254/27
535,805 A * 3/1895 Molloy ..... B25F 1/00 7/142
563,848 A * 7/1896 Dunham ..... B25B 13/48 7/138
1,596,602 A * 8/1926 Eagan ..... B25F 1/00 7/138
1,689,585 A * 10/1928 Haschart ..... B25B 13/48 7/100
D120,609 S * 5/1940 Arnsberger ..... D8/76
3,219,316 A * 11/1965 Fried ..... B25F 1/00 254/131
3,599,255 A * 8/1971 Carroll, Sr. ..... B25F 1/00 254/26 R
4,826,136 A * 5/1989 Thomas ..... B25F 1/00 254/131
D351,326 S * 10/1994 Schwengel ..... D8/88
8,024,994 B2 * 9/2011 St. John ..... B25F 1/00 362/120
2006/0075572 A1 * 4/2006 Young ..... B25B 13/48 7/138

(Continued)

*Primary Examiner* — Hadi Shakeri
(74) *Attorney, Agent, or Firm* — Bacon & Thomas, PLLC

(57) ABSTRACT

The present invention is to provide a demolition utility tool which includes a bar-shaped handle provided with a first tool portion and a second tool portion at two ends thereof, respectively. The first tool portion is formed with a gas shut-off feature for rotating and thereby turning off a gas valve switch, and has one side provided with an axe blade for chopping or breaking apart an object and another side provided with a pike for cutting into an object by a striking action. The second tool portion is U-shaped and configured to rotate a toothed locking element with ease while holding the handle. Therefore, instead of carrying a good number of demolition tools around, a firefighter only needs to bring the demolition utility tool for performing all kinds of demolition operations while in firefighting.

3 Claims, 6 Drawing Sheets

(56) References Cited

U.S. PATENT DOCUMENTS

2009/0000039 A1* 1/2009 St. John ..... E04G 23/08
7/138

* cited by examiner

DEMOLITION UTILITY TOOL

FIELD OF THE INVENTION

The present invention relates to a demolition utility tool, more particularly to a demolition utility tool being used by a firefighter for performing all kinds of demolition operations while in firefighting.

BACKGROUND OF THE INVENTION

According to statistics, death in a fire results far more frequently from choking or suffocation than from burning. The main reason for this lies in the fact that fire tends to break out at night or while people are asleep, during which time the doors and windows of the fire scene are often shut and therefore keep the heavy smoke from dissipating. Closed doors and windows also hinder evacuation and make it difficult for firefighters to advance fire hoses into a building to put out fire. As a result, firefighters or rescue team members must break the closed doors or windows with axes or other tools to enable water application to the interior of the building or help those trapped in the building to escape.

In order not to lose time in firefighting or rescuing, forced entry by demolition is typically required; hence, the removal of obstacles is practically a standard operation. For example, doors or windows must be destroyed; wood panels or walls, knocked down; or bolts or nails, unfastened. To effectively remove the foregoing and other obstacles, the corresponding tools are called for, which include axes, wrenches, chisels, and so on. A firefighter, therefore, must bring several tools with him so that different demolition operations can be executed to save people from danger without delay.

However, the ways in which the demolition operations are performed give rise to various problems. First of all, a firefighter wishing to carry multiple tools with him must put each tool in a proper place, and because of that, the firefighter's clothes must have the corresponding receiving spaces (e.g., pockets) or elements (e.g., a belt or waist bag). Consequently, not only are costs incurred for purchasing the tools and modifying the clothes, but also the firefighter may be inconvenienced by the tools carried. Second, the total weight of the tools can be considerable and will add to the already heavy burden on a firefighter. As firefighters tend to run in order to save time, the extra weight of the tools is very likely to accelerate the consumption of physical energy or even lead to premature fatigue, which will in turn delay the firefighting or rescue operation, if not putting the firefighters themselves in danger. Last but not least, a firefighter carrying several tools with him must choose the right tool for the type of demolition operation on hand (e.g., to destroy a door or window, to knock down a wood panel or wall, or to unfasten a bolt or screw), and yet choosing the right tool can be time-consuming or difficult if the firefighter's vision is compromised by smoke or darkness at the site.

Hence, it is an important issue in the demolition tool industry to improve the existing products so that firefighters and rescue team members can carry fewer tools with them but are still capable of effectively performing various demolition operations and saving people or objects from danger as quickly as possible.

BRIEF SUMMARY OF THE INVENTION

In view of the fact that the conventional demolition tools mentioned above are single-function in nature and present problems to firefighters and rescue team members in terms of use, the inventor of the present invention incorporated years of practical experience into long-term research and experiment and finally succeeded in developing a demolition utility tool which is easy to use and is adaptive to different demolition operations.

It is an objective of the present invention to provide a demolition utility tool which includes a handle, a first tool portion, and a second tool portion. The handle is bar-shaped and is provided with the first tool portion and the second tool portion at two ends respectively. The first tool portion is formed with a gas shut-off feature engageable with a gas valve switch (e.g., a gas valve switch for controlling the supply of gas as a fuel) so that a user holding the handle can rotate and thereby turn off the gas valve switch. One side of the first tool portion is provided with an axe blade for chopping or breaking apart an object (e.g., a tree, wall, or door panel), and a corresponding side of the first tool portion is provided with a pike for cutting into an object (e.g., a tree or floor) by a striking action. The second tool portion is U-shaped and is provided at the end of the handle that is opposite the first tool portion. The second tool portion is configured to engage with a toothed locking element (e.g., a nut or bolt) so that a user can rotate the locking element with ease while holding the handle. Therefore, instead of carrying a good number of demolition tools around, one only has to bring the demolition utility tool with them in order to perform in a firefighting or demolition operation the chopping, cutting, or removing action required for each task on hand. Consequently, not only can the fighting or demolition operation be executed with great ease, but also the executor's safety is substantially enhanced.

BRIEF DESCRIPTION OF THE SEVERAL VIEWS OF THE DRAWINGS

The objectives, technical features, and effects of the present invention will be best understood by referring to the following detailed description of some illustrative embodiments in conjunction with the accompanying drawings, in which.

DETAILED DESCRIPTION OF THE INVENTION

Figure 1:
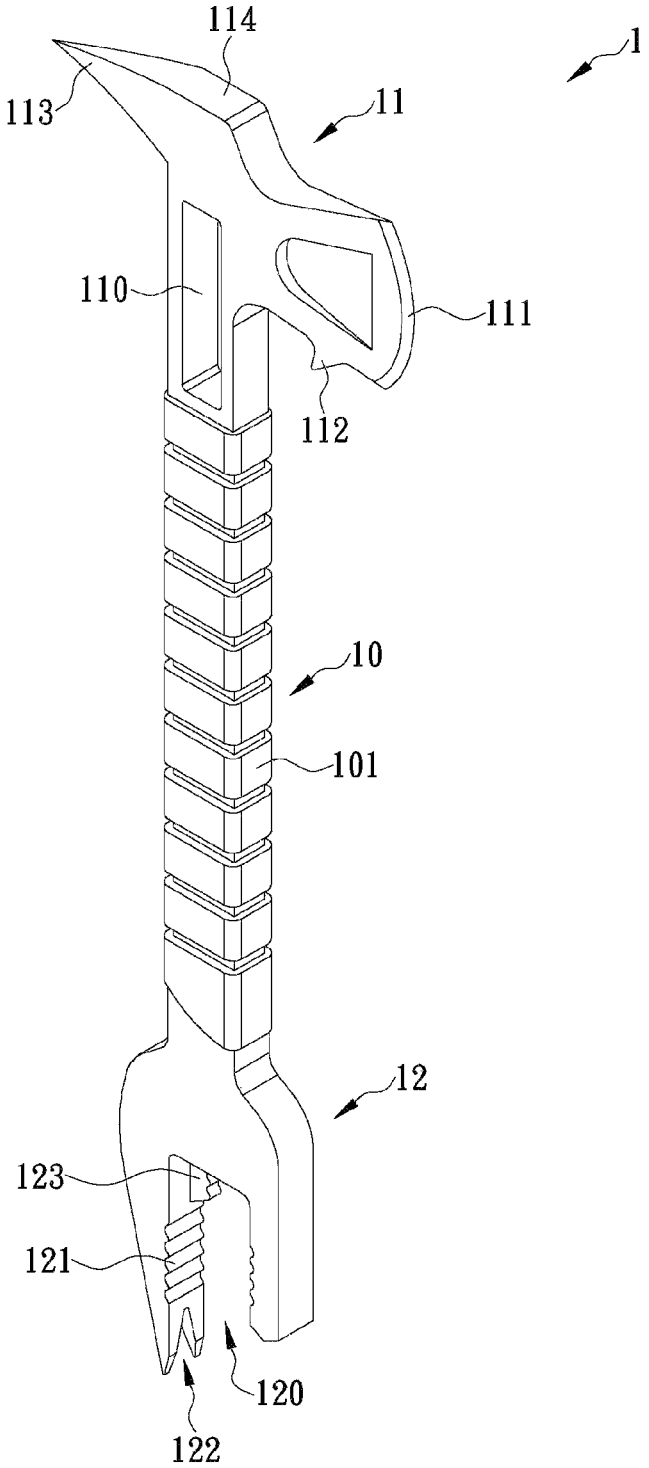
FIG. 1 is a perspective view of a demolition utility tool according to the present invention.
Figure 2:
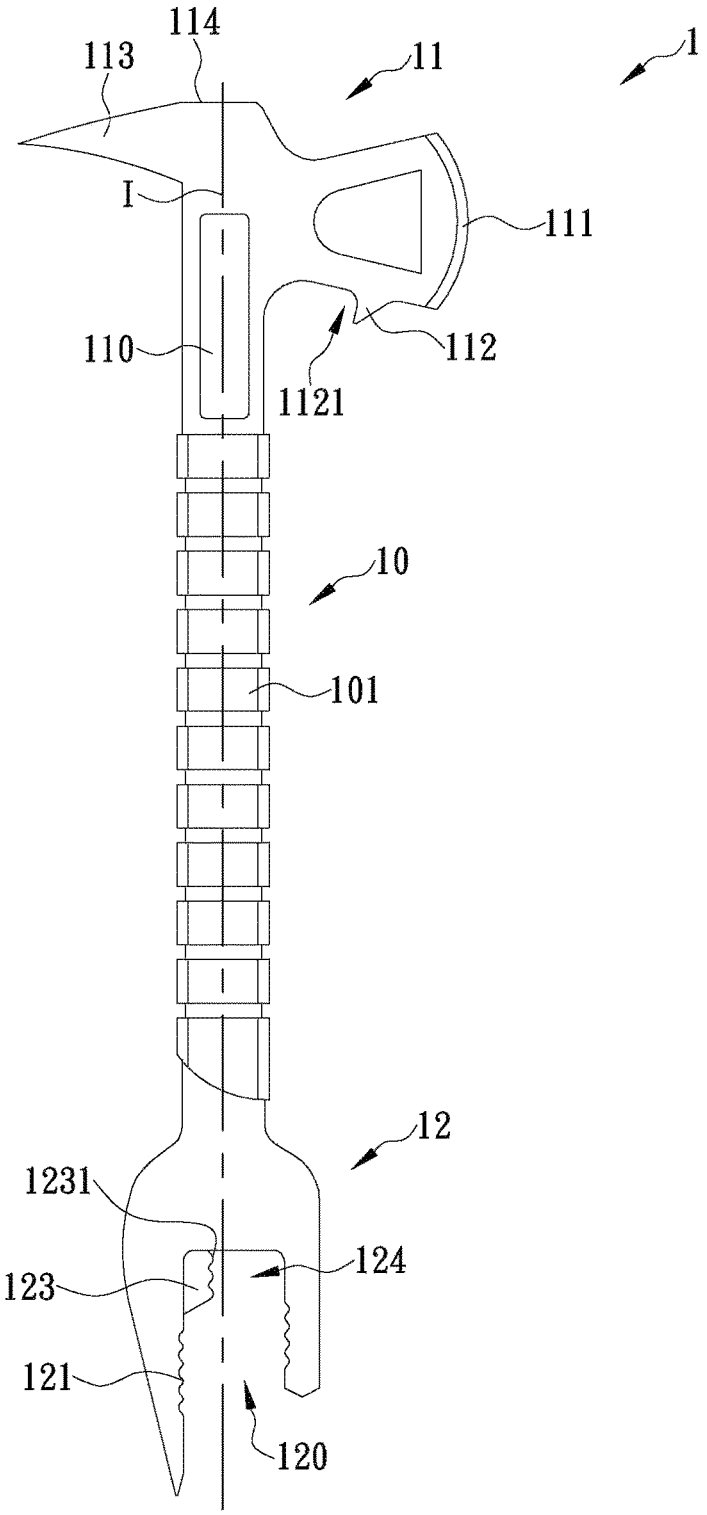
FIG. 2 is a front view of the demolition utility tool in FIG. 1.
Figure 3:
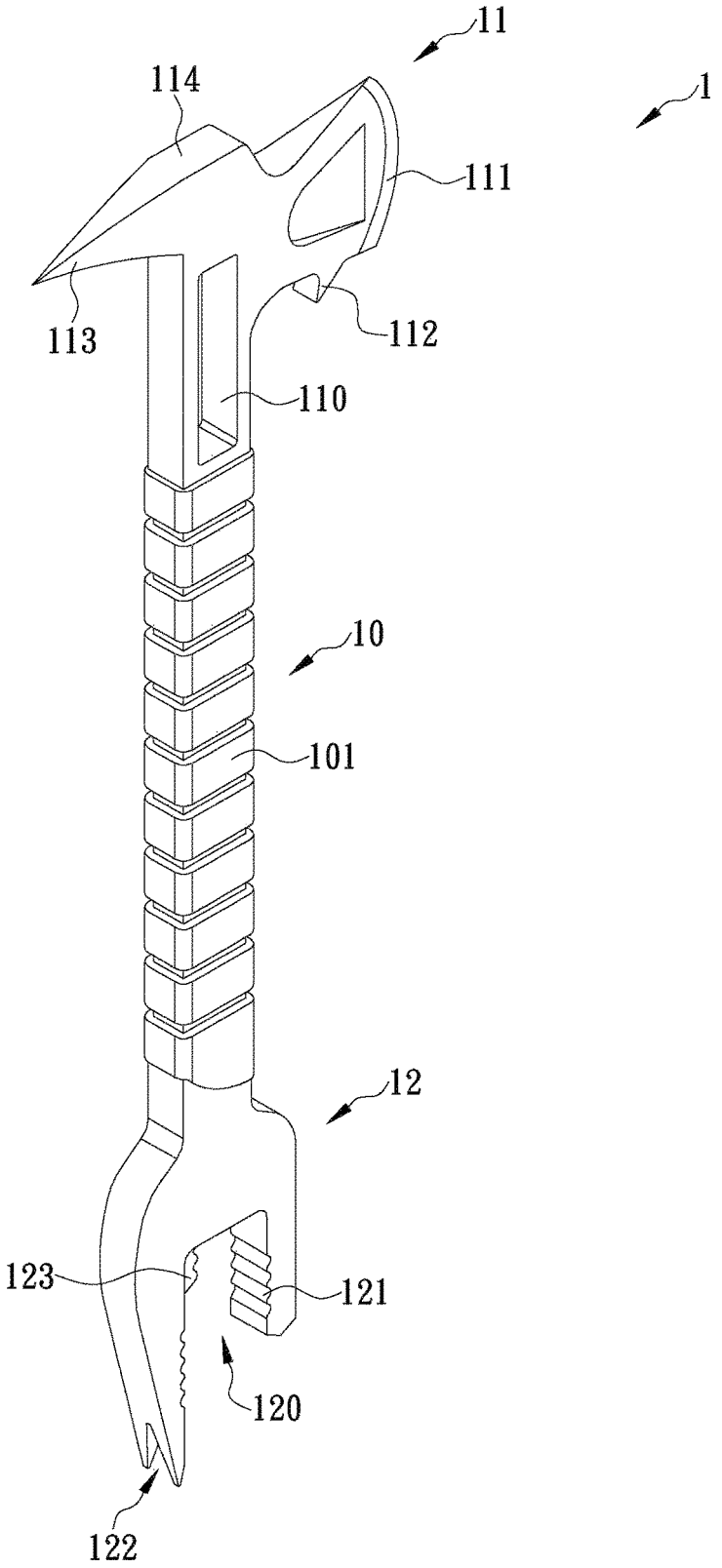
FIG. 3 is another perspective view of the demolition utility tool in FIG. 1.

The present invention provides a demolition utility tool 1, whose overall structure is clearly shown in the different views of FIGS. 1~3. In this embodiment, the demolition utility tool 1 includes a handle 10, a first tool portion 11, and a second tool portion 12. The handle 10 is bar-shaped and has two ends respectively provided with the first tool portion 11 and the second tool portion 12 so that a user can use the first tool portion 11 or the second tool portion 12 for demolition while holding the handle 10. In this embodiment, the handle 10, the first tool portion 11, and the second tool portion 12 are integrally formed. In other embodiments of the present invention, however, the first tool portion 11 and the second tool portion 12 can be mounted to the handle 10 by various mounting methods such as by locking, threaded connection, mutual engagement, etc.

With continued reference to FIGS. 1~3, the outer surface of the handle 10 is covered with at least one anti-slip layer 101 to enable a user of the demolition utility tool 1 to have a firm grip around the handle 10. The anti-slip layer 101 can be rubber, plastic, epoxy resin, or other anti-slip material. In addition, the surface of the anti-slip layer 101 can be flat, studded, or in other configurations to provide an enhanced anti-slip effect when the handle 10 is held. The goal is to prevent the demolition utility tool 1 from slipping off the user's hand during demolition operation, thereby protecting the user from injury and keeping the demolition operation from delay as may otherwise result from such slippage. In other embodiments of the present invention, the material and shape (e.g., wavy or otherwise) of the handle 10 and the location and area of the anti-slip layer 101 can be adjusted according to practical needs so that the demolition utility tool 1 can be held and operated with greater ease.

Figure 4:
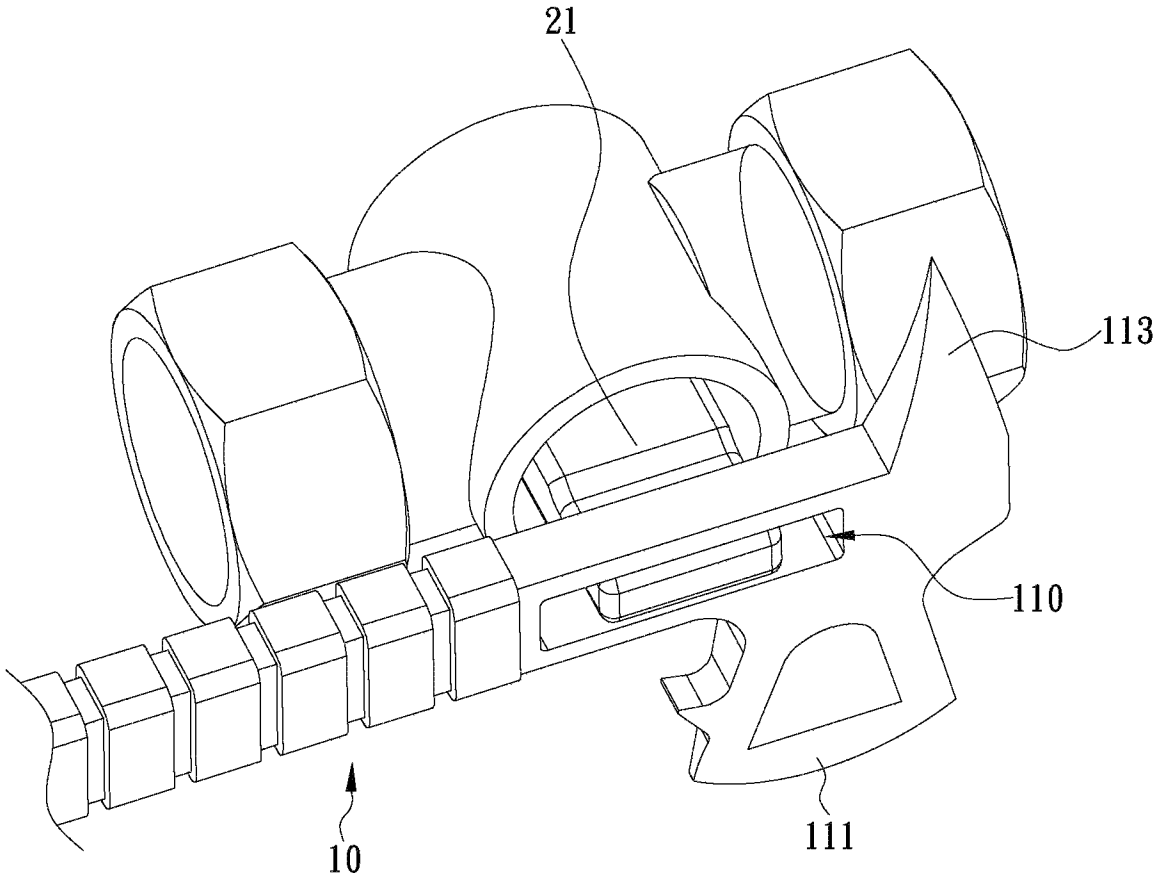
FIG. 4 shows how the demolition utility tool in FIG. 1 is applied to a gas valve switch.

As shown in FIGS. 1~3, the first tool portion 11 is provided at one end of the handle 10 and is formed with and penetrated by a gas shut-off feature 110. When it is desired to turn off a gas valve switch 21 (e.g., a gas valve switch for controlling the supply of a fuel gas, see FIG. 4), the user can fit the gas shut-off feature 110 around the gas valve switch 21 while holding the handle 10 and then push the demolition utility tool 1 about a rotation axis defined by the gas shut-off feature 110, thereby turning off the gas valve switch 21 by a rotating action. While the gas shut-off feature 110 in this embodiment is shown in the drawings as a rectangular hole, the shape of the gas shut-off feature 110 can be modified as needed. In other embodiments, it is also feasible that the gas shut-off feature 110 does not extend through the first tool portion 11, and in that case, the first tool portion 11 can be provided with the gas shut-off feature 110 and another gas shut-off feature (not shown) on two different sides respectively.

Figure 5:
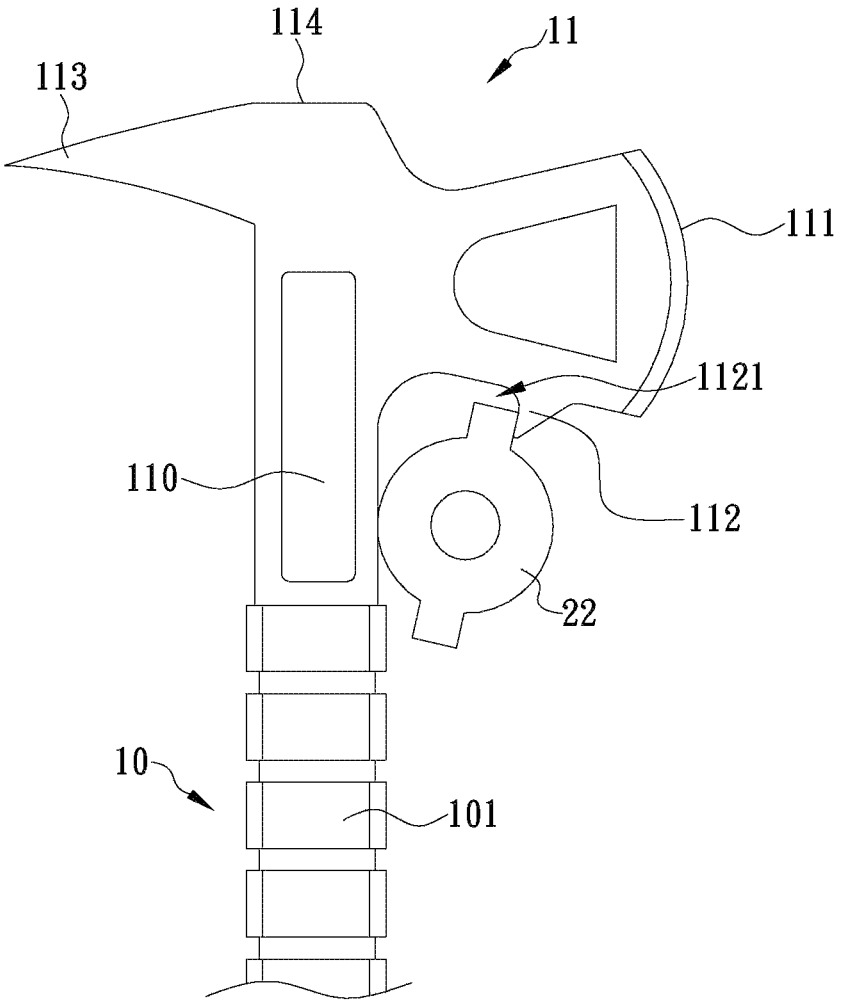
FIG. 5 shows how the demolition utility tool of FIG. 1 is applied to a locked object.

Referring again to FIGS. 1~3, one side of the first tool portion 11 is provided with an outwardly extending axe blade 111, whose sharp edge can be used to chop or break apart an object (e.g., a tree, wall, or door panel), and a corresponding side of the first tool portion 11 is provided with an outwardly extending pike 113 for cutting into an object (e.g., a tree or floor) by a striking action. Thus, one who holds the handle 10 can direct either the axe blade 111 or the pike 113 toward a target object according to current demolition needs in order to complete the demolition operation rapidly. Moreover, the axe blade 111 is protrudingly provided with a spanner wrench 112 adjacent to the sharp edge of the axe blade 111, and a rotation space 1121 (see FIG. 2) is formed between the spanner wrench 112 and an edge of the axe blade 111. As shown in FIG. 5, the spanner wrench 112 can be pressed against an edge of a fire hydrant bolt, fire hydrant nut, or other locked object 22 such that the head of the fire hydrant bolt or nut or other locked object 22 is located in the rotation space 1121. Then, the fire hydrant bolt or nut or other locked object can be turned by manipulating the demolition utility tool 1. In other embodiments of the present invention, the spanner wrench 112 can be provided elsewhere on the first tool portion 11 (e.g., near the pike 113) just as well, with the rotation space 1121 formed between the spanner wrench 112 and an edge of the first tool portion 11.

In the embodiment shown in FIGS. 1~3, the second tool portion 12 is provided at the end of the handle 10 that is opposite the first tool portion 11. The second tool portion 12 has a U-shaped configuration and is formed with a first clamping space 120. When it is desired to remove or rotate a locking element (e.g., a nut or bolt), the user can place the demolition utility tool 1 in such a way that the locking element lies in the first clamping space 120 and is clamped by the second tool portion 12. Then, the user can rotate the locking element with the second tool portion 12 while holding the handle 10. Since certain locking elements are peripherally provided with external teeth, at least one inner face of the second tool portion 12 that corresponds to the first clamping space 120 is further protrudingly provided with a plurality of first internal teeth 121. The first internal teeth 121 serve to engage with the external teeth of a locking element so that the user can remove the locking element in a steady and convenient manner. In this embodiment, the first internal teeth 121 are provided on two corresponding inner faces of the second tool portion 12. Additionally, the inner side of at least one end of the second tool portion 12 is protrudingly provided with a clamping block 123 such that a second clamping space 124 is formed in the second tool portion 12. The second clamping space 124 has a smaller width than the first clamping space 120 and adds significantly to the convenience of use because the former can receive a locking element of a different size from that which the latter can accommodate. The face of the clamping block 123 that corresponds to the second clamping space 124 can be further protrudingly provided with a plurality of second internal teeth 1231 for engaging with the external teeth of a locking element.

Figure 6:
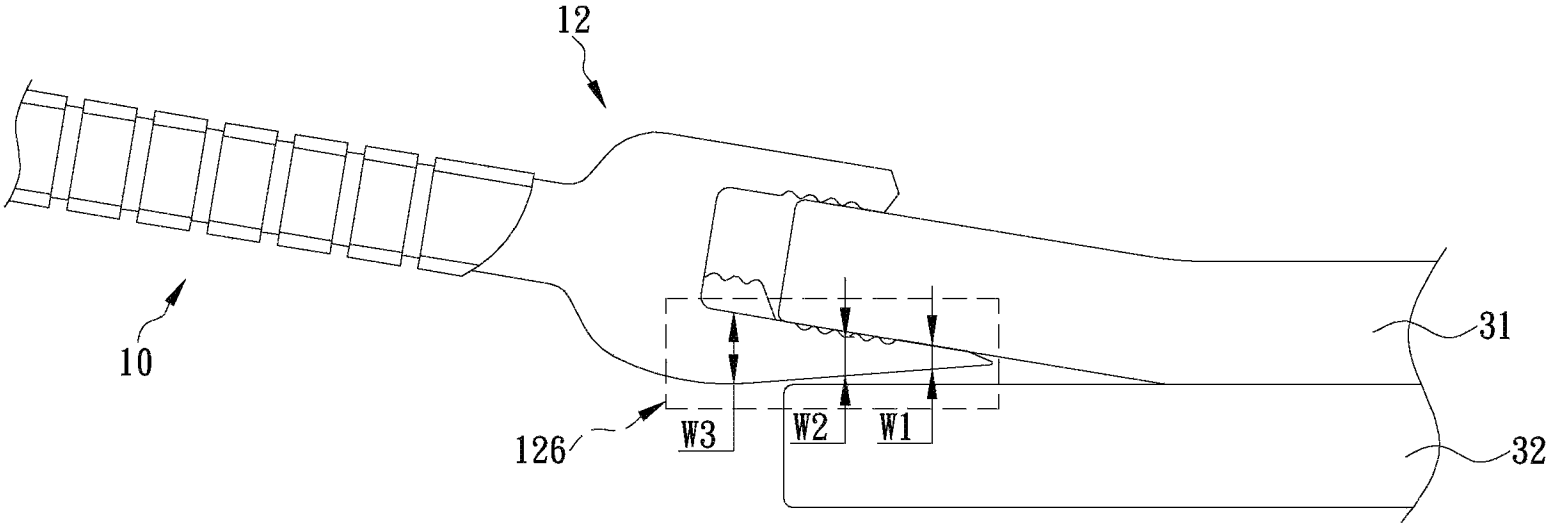
FIG. 6 shows how the demolition utility tool of FIG. 1 is applied to two fixed objects.

As shown in FIGS. 1~3, at least one end of the second tool portion 12 is so configured that its transverse width increases from the outside inward (see FIG. 6, with the transverse width W1 less than the transverse width W2, and the transverse width W2 less than the transverse width W3). Thus, a pry bar 126 (i.e., the portion enclosed in the dashed-line rectangle) is formed, which can be inserted in between two fixed objects 31 and 32 to move one of the fixed objects 31 and 32 apart from the other. In this embodiment, the first tool portion 11 has an end edge which is distant from the handle 10 and provided with a strike contact face 114. As shown in FIG. 2, the strike contact face 114 is perpendicular to the axis I of the demolition utility tool 1 and is depicted as horizontal. The user can strike the strike contact face 114 with a hammer or other tool in order to drive the aforesaid end of the second tool portion 12 deep into the gap between the two fixed objects 31 and 32 rapidly. Also, the second tool portion 12 has at least one end edge which is distant from the handle 10 and formed with a gap 122. The gap 122 extends inward and is V-shaped. When it is desired to remove a fastener (e.g., a nail) whose exposed portion has a smaller width than the first clamping space 120 and the second clamping space 124 (see FIG. 2) and therefore cannot be clamped in the first clamping space 120 or the second clamping space 124 of the second tool portion 12 (i.e., the corresponding two inner faces of the second tool portion 12 are unable to contact with the periphery of the fastener at the same time), the user can fit the fastener into the gap 122 of the second tool portion 12 and pull out the fastener with the second tool portion 12. It should be pointed out that, due to its inwardly decreasing width, the gap 122 can adapt to fasteners of different specifications, making the demolition utility tool 1 even more useful.

According to the above, referring back to FIGS. 1~3, a firefighter or rescue team member only has to bring the demolition utility tool 1 with him, and he will be able to clear each obstacle to which the demolition utility tool 1 is applicable in a firefighting, demolition, or rescue operation by performing the corresponding chopping, cutting, or removing action. That is to say, it is no longer necessary for a firefighter or rescue team member to carry a lot of single-function tools around. In addition to effectively reducing the load on the user, the demolition utility tool 1 can be promptly used according to the current situation, without the user having to pick the right tool from among many. Thus, the present invention not only facilitates the execution of a firefighting, demolition, or rescue operation, but also enhances the user's safety greatly.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A demolition utility tool, comprising:

a handle having a longitudinal axis defining two ends;

a first tool portion provided at one of said two ends of the handle, wherein the first tool portion is formed with a gas shut-off through hole engageable with a gas valve switch, the first tool portion has a first side on one side of the axis provided with an axe blade for chopping or breaking apart an object, and has a second side opposite to the first side and provided with a pike distal to the gas shut-off through hole for cutting into an object by a striking action;

a spanner wrench provided at a side of the axe blade adjacent to the handle such that a rotation space is formed between the spanner wrench and an outer edge of the first tool portion corresponding to the gas shut-off through hole; and a second tool portion provided at the other end of the handle, wherein the second tool portion is U-shaped extending substantially symmetrically along the longitudinal axis of the handle and formed with a first clamping space and a second clamping space therein in a direction opposite to the first tool portion, the second clamping space has a smaller width than the first clamping space, the second tool portion has at least one end forming a pry bar for moving at least one fixed object by a prying action, the pry bar being formed with a gap with an inwardly increasing transverse width engageable with a fastener so that the fastener can be pulled out; and wherein at least one inner surface of the second tool portion corresponding to the first clamping space is protruding provided with a plurality of first internal teeth for rotating a locking element located in the first clamping space, inner surface of the second tool portion corresponding to the second clamping space is protruding provided with a clamping block, and the surface of the clamping block corresponding to the second clamping space is further protruding provided with a plurality of second internal teeth for rotating a locking element located in the second clamping space.

2. The demolition utility tool of claim 1, wherein the handle has an outer surface covered with at least one anti-slip layer.

3. The demolition utility tool of claim 2, wherein the handle, the first tool portion, and the second tool portion are integrally formed.

* * * * *